United States Patent [19]

Grammatica et al.

[11] Patent Number: 5,077,578

[45] Date of Patent: Dec. 31, 1991

[54] DEVELOPMENT SYSTEM

[75] Inventors: Steven J. Grammatica, Penfield; John F. Knapp, Fairport, both of N.Y.

[73] Assignee: Xerox Corporation, Stamford, Conn.

[21] Appl. No.: 692,431

[22] Filed: Apr. 29, 1991

[51] Int. Cl.[5] ..... G03G 15/06

[52] U.S. Cl. ..... 355/259; 118/651

[58] Field of Search ..... 118/651, 653; 355/259, 355/261

[56] References Cited

U.S. PATENT DOCUMENTS 4,480,911 11/1984 Itaya et al. ..... 355/259 X 4,876,575 10/1989 Hays ..... 355/259

OTHER PUBLICATIONS

Xerox Copending patent application Ser. No. 07/428,726; Applicant: Brewington et al., Filed: Oct. 30, 1989.

Xerox Copending patent application Ser. No. 07/537,660; Applicant: Brewington et al., Filed: Jun. 14, 1990.

*Primary Examiner*—A. T. Grimley

*Assistant Examiner*—P. Stanzione

*Attorney, Agent, or Firm*—H. Fleischer; J. E. Beck; R. Zibelli

[57] ABSTRACT

An apparatus which develops an electrostatic latent image recorded on a photoconductive member with toner. The toner in the chamber of the developer housing is fluidized and transported thereacross by an elongated member. A donor roller advances the toner particles to a latent image recorded on a photoconductive member. A rotating rod resiliently urged into contact with the donor roller charges the toner on the donor roller. In order to attract toner particles to the donor roller, the elongated member and the charging rod are electrically biased by voltages having the same polarity. The elongated member and the charging rod are electrically biased by voltages of opposite polarity to denude the donor roller of toner particles.

18 Claims, 3 Drawing Sheets

DEVELOPMENT SYSTEM

This invention relates generally to an electrophotographic printing machine, and more particularly concerns a single component development system.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. An electrical bias is applied between the donor roll and the photoconductive member. Toner is attracted from the donor roll to the latent image to develop the latent image. A large continuous supply of toner particles must be available to be capable of copying large numbers of original documents producing multiple copies of the same original document. This is necessary in order to insure that the printing machine is not shut down after relatively short operating intervals due to the lack of toner particles. This is achieved by storing a supply of toner particles in a toner container and dispensing additional toner particles into one end of the developer housing chamber. The toner particles are then transported across the chamber of the developer housing and advanced to the donor roller. It is frequently desirable to be able to quickly detone the donor roll. This helps to prevent scumming of the donor roll caused by adhesion of small, highly charged toner particles. In addition, this prevents transfer of the toner particles onto the interdocument area of the photoconductive member. Furthermore, having a bare donor roll reduces the amount of toner transferred to the photoconductive member in the non-image areas, thereby reducing color contamination and background in multicolor printing machines. Various types of development systems have hereinbefore been used as illustrated by the following disclosures, which may be relevant to certain aspects of the present invention:

Co-pending U.S. Pat. application Ser. No. 07/428,726
Applicant: Brewington et al.
Filed: October 30, 1989
Co-pending U.S. Pat. application Ser. No. 07/537,660
Applicant: Brewington et al.

-continued
Filed: June 14, 1990

The relevant portions of the foregoing disclosures may be briefly summarized as follows:

Co-pending U.S. patent application Ser. No. 07/428,726 and co-pending U.S. patent application Ser. No. 07/537,660 describe a development system having a hollow tube having holes therein which fluidizes and moves toner particles from one end of a developer housing to the other end thereof. The tube is electrically biased so that toner particles are attracted from the tube to a donor roller. A charging blade is maintained in contact with the donor roll to charge the toner layer on the donor roller.

In accordance with one aspect of the present invention, there is provided an apparatus for developing a latent image recorded on a surface. The apparatus includes a housing defining a chamber storing a supply of marking particles therein. Means, disposed in the chamber of the housing, move the marking particles. A donor member is spaced from the surface and adapted to transport marking particles to a development zone adjacent the surface. Means are provided for charging the marking particles being advanced into contact with the latent image by the donor member. Means electrically bias the moving means to a voltage having a selected magnitude and polarity. Means electrically bias the charging means to a first voltage having the same polarity as the voltage electrically biasing the moving means to attract marking particles to the donor member and to a second voltage opposite in polarity to that of the first voltage to remove marking particles from the donor member.

Pursuant to another aspect of the present invention, there is provided an electrophotographic printing machine of the type in which an electrostatic latent image recorded on a photoconductive member is developed to form a visible image thereof. The improvement includes a housing defining a chamber storing a supply of toner particles therein. Means, disposed in the chamber of the housing, move the toner particles. A donor member is spaced from the photoconductive member and adapted to transport toner particles to a development zone adjacent the photoconductive member. Means are provided for charging the toner particles being advanced into contact with the latent image by the donor member. Means electrically bias the moving means to a voltage having a selected magnitude and polarity. Means electrically bias the charging means to a first voltage having the same polarity as the voltage electrically biasing the moving means to attract marking particles to the donor member and to a second voltage opposite in polarity to that of the first voltage to remove toner particles from the donor member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
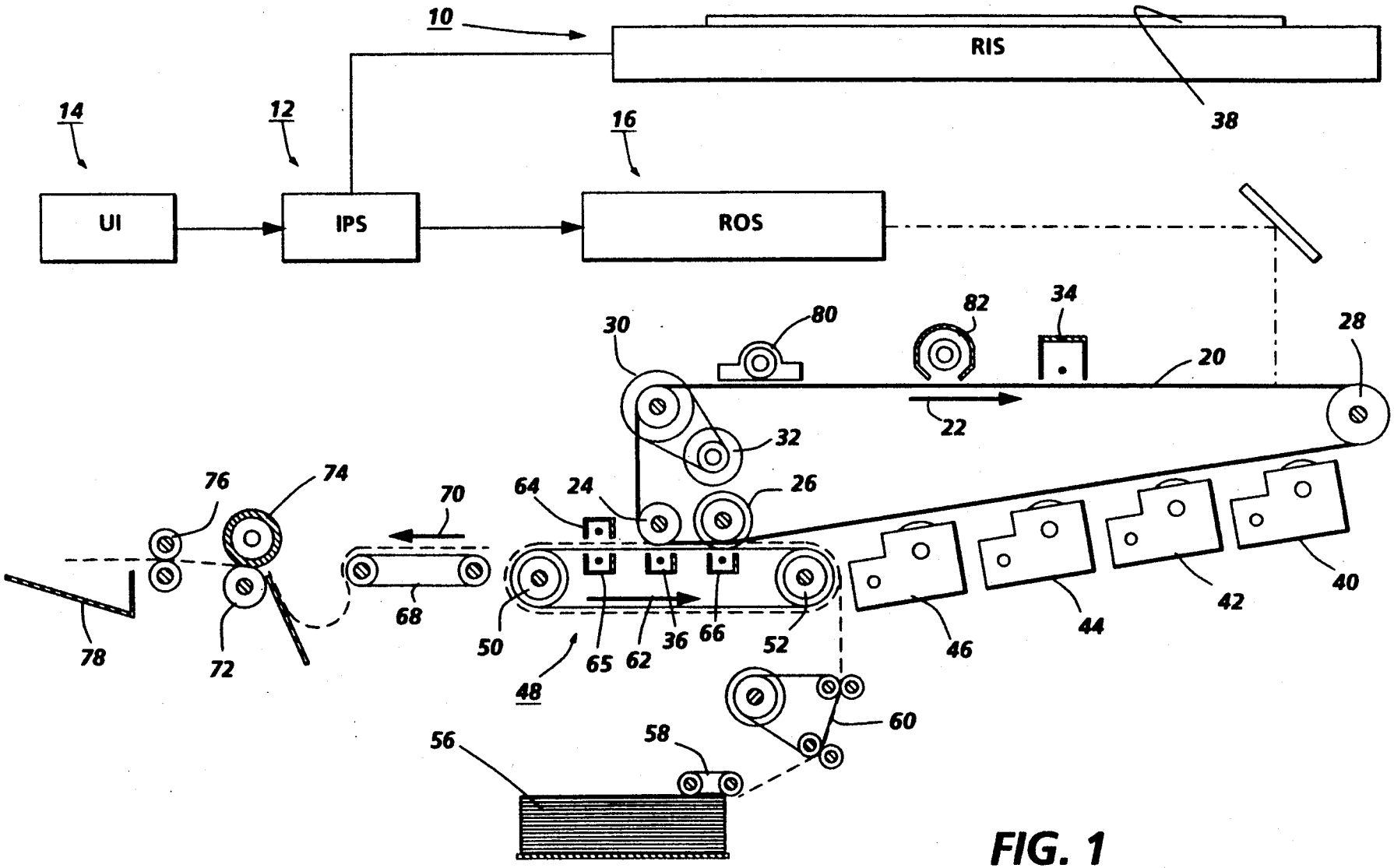
FIG. 1 is a schematic elevational view showing an illustrative color electrophotographic printing machine incorporating several developer units having the features of the present invention therein.

Turning initially to FIG. 1, during operation of the printing machine, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 is the control electronics which prepare and manage the image data flow to the raster output scanner (ROS), indicated generally by the reference numeral 16. A user interface (UI), indicated generally by the reference numeral 14, is in communication with the IPS. The UI enables the operator to control the various operator adjustable functions. The output signal from the UI is transmitted to IPS 12. The signal corresponding to the desired image is transmitted from IPS 12 to ROS 16, which creates the output copy image. ROS 16 lays out the image in a series of horizontal scan lines with each line having a specified number of pixels per inch. The ROS includes a laser having a rotating polygon mirror block associated therewith. The ROS exposes the charged photoconductive surface of belt 20 to record a set of latent images. The latent images are developed with magenta, cyan, yellow, and black toner particles, respectively. These developed images are transferred to a copy sheet in superimposed registration with one another to form a multi-colored image on the copy sheet. This multi-colored image is then fused to the copy sheet forming a color copy.

With continued reference to FIG. 1, photoconductive belt 20 is made from a polychromatic photoconductive material. Belt 20 moves in the direction of arrow 22 to advance successive portions of the photoconductive surface sequentially through the various processing stations disposed about the path of movement thereof. Belt 20 is entrained about transfer roller 24, detack backup roller 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through the charging station. At the charging station, a corona generating device, indicated generally by the reference numeral 34 charges photoconductive belt 20 to a relatively high, substantially uniform potential.

Next, the charged photoconductive surface is rotated to the exposure station. The exposure station includes the RIS 10 having a multicolored original document 38 positioned thereat. The RIS captures the entire image from the original document 38 and converts it to a series of raster scan lines which are transmitted as electrical signals to IPS 12. The electrical signals from the RIS correspond to the red, green and blue densities at each point in the document. The IPS converts the set of red, green and blue density signals, i.e. the set of signals corresponding to the primary color densities of original document 38, to a set of colorimetric coordinates. The operator actuates the appropriate keys of the UI 14 to adjust the parameters of the copy. UI 14 may be a touch screen or any other suitable control panel providing an operator interface with the system. The output signals from the UI are transmitted to the IPS. The IPS then transmits signals corresponding to the desired image to ROS 16. ROS 16 includes a laser with rotating polygon mirror blocks. Preferably, a nine facet polygon is used. The ROS illuminates the charged portion of photoconductive belt 20 at a rate of about 400 pixels per inch. The ROS will expose the photoconductive belt to record four latent images. One latent image is adapted to be developed with cyan toner. Another latent image is adapted to be developed with magenta toner. The third latent image is developed with yellow toner, and the fourth with black toner. The latent images formed by the ROS on the photoconductive belt correspond to the signals from IPS 12.

After the electrostatic latent image has been recorded on photoconductive belt 20, belt 20 advances the electrostatic latent image to the development station. The development station includes four individual developer units generally indicated by the reference numerals 40, 42, 44 and 46. The developer units are of a type generally referred to in the art as "single component development units." Typically, a single component development system employs charged toner particles adhering to a donor roll. A charging blade or rod adjacent the donor roll charges the toner particles and regulates the quantity of toner particles adhering to the donor roll. Development is achieved by bringing the toner particles into contact with the photoconductive surface. Developer units 40, 42, and 44, respectively, apply toner particles of a specific color which corresponds to the compliment of the specific color separated electrostatic latent image recorded on the photoconductive surface. The color of each of the particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 10, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from black information or text. Only one of the developer units is operative during each development cycle. The remaining developer units are non-operative. This prevents co-mingling of different color toner particles. In order to switch the developer unit from the operative to the non-operative mode, toner particles are removed form the non-operative donor roll. In contra distinction, toner particles remain on the donor roll in the operative mode. This insures that each electrostatic latent image is developed with toner particles of the appropriate color without co-mingling.

After development, the toner image is moved to the transfer station where the toner image is transferred to a sheet of support material, such as plain paper amongst others. At the transfer station, the sheet transport apparatus, indicated generally by the reference numeral 48, moves the sheet into contact with photoconductive belt 20. Sheet transport 48 has a pair of spaced belts 54 entrained about rolls 50 and 52. A gripper extends between belts 54 and moves in unison therewith. The sheet is advanced from a stack of sheets 56 disposed on a tray. A friction retard feeder 58 advances the uppermost sheet from stack 56 onto a pre-transfer transport 60. Transport 60 advances the sheet to sheet transport 48. The sheet is advanced by transport 60 in synchronism with the movement of the gripper. In this way, the leading edge of the sheet arrives at a preselected position to be received by the open gripper. The gripper then closes securing the sheet thereto for movement therewith in a recirculating path. The leading edge of the sheet is secured releasably by the gripper. As the belts move in the direction of arrow 62, the sheet moves into contact with the photoconductive belt, in synchronism with the toner image developed thereon. At the transfer zone, a transfer corona generating device 66 sprays ions onto the backside of the sheet so as to charge the sheet to a polarity opposite to that of the charge on the toner image. In this way, the sheet is charged to the proper magnitude and polarity for attracting the toner image from photoconductive belt 20 thereto. The sheet is then separated from photoconductive belt 20. After the toner image is transferred to the sheet and the sheet separated from photoconductive belt 20, the sheet passes between upper neutralizing corona generator 64 and lower neutralizing corona generator 65. The upper neutralization corona generator 64 applies a charge to the toner image of opposite polarity to the polarity on the toner image. The lower neutralization corona generator 65 applies a charge to the sheet of the same polarity as the charge on the toner image. The charge delivered to the toner image by upper neutralization corona generator 64 serves to discharge the toner image that was just transferred to the sheet, and, in so doing, improves the efficiency of the transfer of the next toner image in those areas where the transfer must occur on top of the now discharged toner image. The function of lower neutralization corona generator 65 is to act as a ground plane behind the sheet and supply an amount of charge equal to that supplied by upper neutralization corona generator 64 to the toner image but of opposite polarity. The sheet remains secured to the gripper so as to move in a recirculating path for four cycles. In this way, four different color toner images are transferred to the sheet in superimposed registration with one another. Each of the electrostatic latent images recorded on the photoconductive surface is developed with the appropriately colored toner which are transferred, in superimposed registration with one another, to the sheet to form the multi-color copy of the colored original document.

Following each transfer operation, detack corona generator 36 is energized to apply a charge to the sheet of a polarity which is the same as that of the charge on the toner image to separate the sheet from the photoconductive belt 20. After the last separation, the grippers open to release the sheet. Conveyor 68 transports the sheet, in the direction of arrow 70, to the fusing station where the transferred image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by forwarding roll pairs 76 to catch tray 78 for subsequent removal therefrom by the machine operator.

The last processing station in the direction of movement of belt 20, as indicated by arrow 22, is the cleaning station. A rotatably mounted fibrous brush 80 is positioned in the cleaning station and maintained in contact with photoconductive belt 20 to remove residual toner particles remaining after the transfer/detack operation. Thereafter, lamp 82 illuminates photoconductive belt 20 to remove any residual charge remaining thereon prior to the start of the next successive cycle.

It is believed that the foregoing description is sufficient for purposes of the present application to illustrate the general operation of an electrophotographic printing machine incorporating the development apparatus of the present invention therein.

Figure 2:
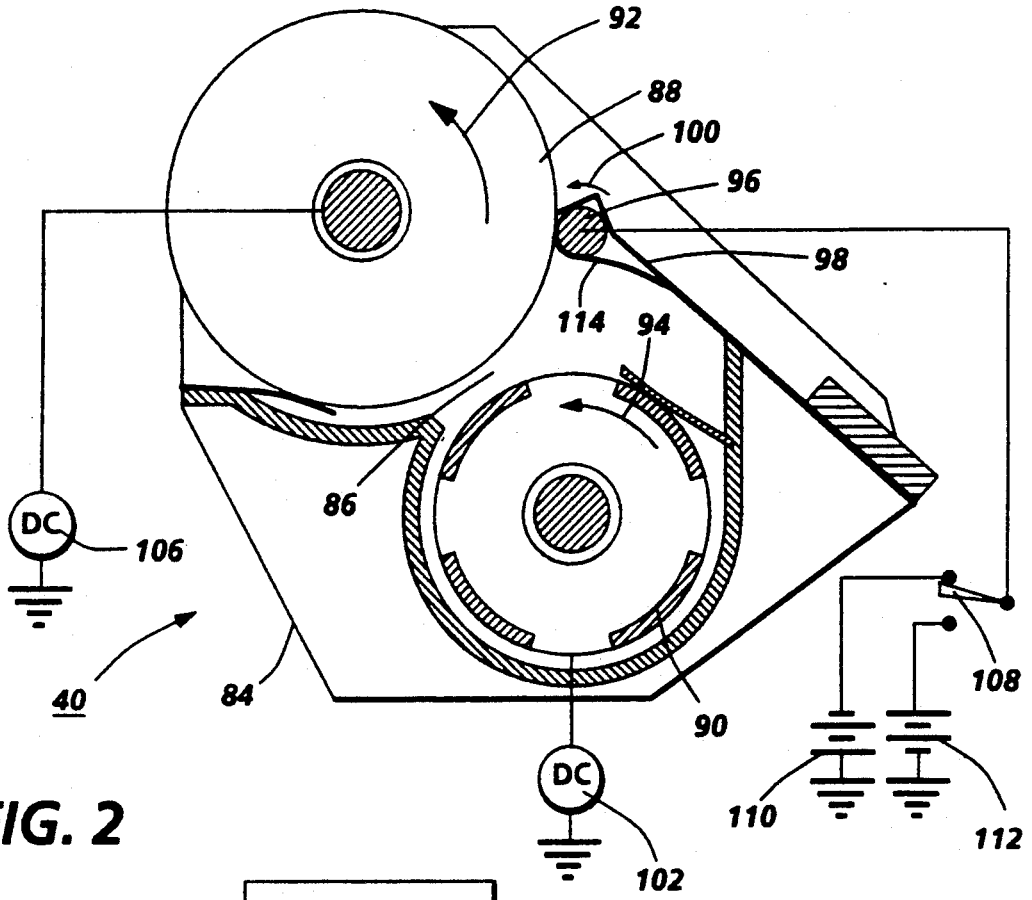
FIG. 2 is a schematic front elevational view showing one of the developer unit used in the FIG. 1 printing machine.
Figure 3:
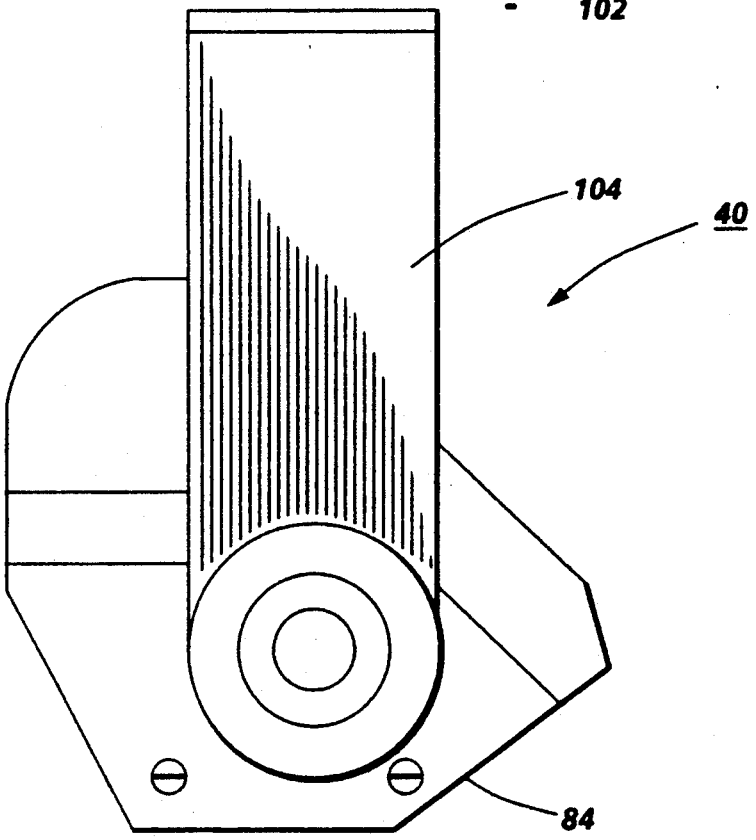
FIG. 3 is a schematic side elevational view depicting the FIG. 2 developer unit.

Referring now to FIGS. 2 and 3, there is shown developer unit 40 in greater detail. Only developer unit 40 will be discussed inasmuch as the other developer units are identical thereto, the only distinction being the color of the toner particles therein. As shown thereat, developer unit 40 includes a housing 84 defining a chamber 86 for storing a supply of toner particles therein. Donor roller 88 and toner mover 90 are mounted in chamber 86 of housing 84. The donor roller can be rotated in either the 'with' or 'against' direction relative to the direction of motion of belt 20. In FIG. 2, donor roller 88 is shown rotating in the direction of arrow 92. Similarly, the toner mover 90 can be rotated in either the 'with' or 'against' direction relative to the direction of motion of belt 10. In FIG. 2, toner mover 90 is shown rotating in the direction of arrow 94. A charging rod 96 is resiliently urged into engagement with donor roller 88. Charging rod 96 rotates in the direction of arrow 100. A leaf spring 98 supports charging rod 96. The leaf spring 98 is mounted in chamber 86 of housing 84 with the free end rotatably supporting charging rod 96. One skilled in the art will appreciate that any suitable spring may be used to support charging rod 96 and to resiliently urge it into contact with donor roller 88 and that a charging blade may be used in lieu of a charging rod. Leaf spring 98 is preferably made from sheet steel. Charging rod 96 charges the toner particles adhering to donor roller 88 and regulates the thickness of the layer of toner particles on donor roller 88. Preferably, charging rod 96 is made from steel having a nickel coating of about 0.013 mm. Donor roller 88 is preferably made from anodized aluminum having a polytetrafluorethylene based resin of about 0.05 mm coated thereon. This coating acts to assist in charging the toner particles adhering to the surface thereof.

As illustrated in FIG. 2, a DC voltage source 102 electrically biases toner mover 90 to approximately −750 volts. DC voltage source 106 electrically biases donor roll 88 to about +300 volts. This establishes an electrostatic field between toner mover 90 and donor roller 88. Toner particles are attracted from toner mover 90 to donor roll 88. Toner mover 90 agitates and fluidizes the toner particles. The fluidized toner particles seek their own level under the influence of the gravity. Inasmuch as new toner particles are being discharged from a container 104 (FIG. 3), located at one end of housing 84, into one end of the chamber 86, the force exerted on the fluidized toner particles by the new toner particles being added at that end moves the fluidized toner particles from that end of housing to the other end thereof. Toner mover 90 is an elongated member located in chamber 86. New toner particles are discharged into one end of chamber 86 from container 104. As elongated member 90 rotates in the direction of arrow 94, toner particles are fluidized. A motor (not shown) rotates elongated member 90 at an angular velocity ranging from about 200 to about 600 revolutions per minute with the preferred set point being about 400 revolutions per minute. The force exerted on the fluidized toner particles by the new particles being discharged into chamber 86 advances the fluidized toner particles from the end of the chamber in which the new toner particles have been discharged to the other end thereof. The fluidized toner particles being moved are attracted to donor roller 88. Elongated member 90 is made from an electrically conductive material, such as aluminum, coated with an insulating material, such as a plastic material. Elongated member 90 is spaced from donor roller 88 to define a gap therebetween. This gap is preferably about 1.0 mm. Donor roller 88 rotates in the direction of arrow 92 to move the toner particles attracted thereto into contact with the electrostatic latent image recorded on photoconductive surface of belt 20. As donor roller 40 rotates in the direction of arrow 92, charging rod 96 is resiliently urged into contact with donor roller 88. Charging rod 96 is maintained in contact with donor roller 88 at a nominal nip force ranging from about 25 grams per centimeter to about 100 grams per centimeter. Charging rod 96 is connected electrically to switch 108. Switch 108 connects charging rod 96 to either voltage source 110 or voltage source 112. Voltage sources 110 and 112 electrically bias charging rod 96 to about the same magnitude, i.e. about 200 volts relative to the donor roll. However, the polarity of the voltage is opposite. Voltage source 112 applies a negative voltage of about 200 volts to charging rod 96 while voltage source 110 applies a positive voltage of about 200 volts. When switch 108 connects voltage source 112 to charging rod 96, the toner particle layer adhering to donor roller 88 is charged to a maximum of 20 microcoulombs with the toner mass adhering thereto being about 0.4 milligrams per centimeter$^2$ of roll surface. In contradistinction, when switch 108 connects voltage source 110 to charging rod 96, toner particles are repelled from the donor roll. It is thus seen that when charging rod 96 is electrically biased by a voltage having the same polarity as the voltage electrically biasing toner mover 90, toner particles adhere to donor roller 88. However, when charging rod 96 is electrically biased by a voltage having the opposite polarity to the voltage electrically biasing toner mover 90, toner particles are repelled from donor roller 88. Elongated member 90 continually fluidizes these toner particles. These fluidized toner particles are attracted from elongated member 90 to donor roller 88. A cleaning blade 114 is mounted in chamber 86 of housing 84 with the free end thereof contacting charging rod 96. The cleaning blade removes the toner particles adhering to the charging rod.

As shown in FIG. 2, elongated member 86 includes a hollow rod or tube having four equally spaced rows of apertures or holes therein. Each row of holes is spaced about the periphery of rod by about 90°. Each hole in each row is spaced from the next adjacent hole. The holes are equally spaced from one another. In this way, as the tube rotates, the toner particles travel through the center of the tube and out through the various holes so as to be fluidized. The fluidized toner particles are advanced from one end of the chamber of the developer housing to the other end thereof by the back pressure exerted by the head of fresh or new toner particles being discharged into the chamber from the toner storage container 104 (FIG. 3). Alternatively, elongated member 90 may be a rod having a cylindrical member mounted thereon. The cylindrical member has a plurality of spaced saw tooth shaped paddles extending outwardly therefrom. As elongated member 86 rotates, the paddles agitate and fluidize the toner particles. The toner particles fly off the tips of the saw tooth shaped paddles so as to be fluidized. The pressure or force exerted on the fluidized toner particles by the new toner particles being discharged from toner container 104 (FIG. 3) moves the fluidized toner particles from one end of the chamber 86 (FIG. 2) of housing 84 (FIG. 2) to the other end thereof.

Figure 4:
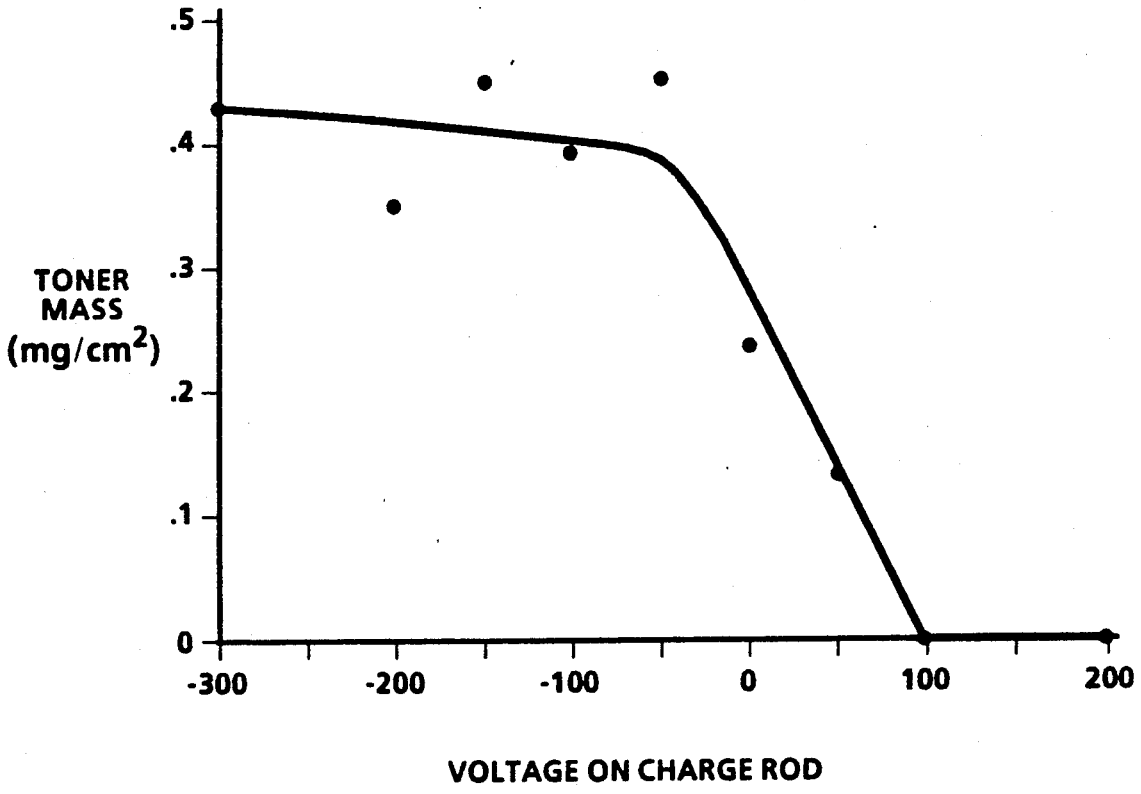
FIG. 4 is a graph showing the variation in toner mass on the donor roll of the FIG. 2 developer unit as a function of the voltage on the charging rod used therein.

Referring now to FIG. 4, there is shown a graph of the toner mass on the donor roll as a function of the voltage applied on the charging rod. When the voltage applied on the charging rod is of the same polarity as that being applied to the toner mover and has a magnitude ranging from about −100 volts to about −300 volts, approximately 0.4 milligrams per centimeter$^2$ of toner particles are on the surface of the donor roll. When the polarity of the electrically bias being applied to the charging rod is switched, i.e. so that the polarity is opposite to the polarity of the voltage being applied on the toner mover, the donor roll is denuded of toner particles.

In recapitulation, it is evident that the development apparatus of the present invention includes a donor roller having a charging rod resiliently urged into contact therewith for charging the toner particles and regulating the quantity thereof. Toner particles adhere to the donor roll when the charging rod is electrically biased to a voltage having the same polarity as the voltage electrically biasing the toner mover. When the polarity is reversed, the donor roll is denuded of toner particles. In this manner, the developer unit may be switched from the operative mode to the non-operative mode, i.e. merely by changing the polarity of the electrical bias being applied on the charging rod.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for developing a latent image recorded on a surface, including:

a housing defining a chamber storing a supply of marking particles therein;

means, disposed in the chamber of said housing, for moving the marking particles;

a donor member spaced from the surface and adapted to transport marking particles to a development zone adjacent the surface;

means for charging the marking particles being advanced into contact with the latent image by said donor member;

means for electrically biasing said moving means to a voltage having a selected magnitude and polarity; and means for electrically biasing said charging means to a first voltage having the same polarity as the voltage electrically biasing said moving means to attract marking particles to said donor member and to a second voltage opposite in polarity to that of the first voltage to remove marking particles from said donor member.

2. An apparatus according to claim 1, wherein said charging means regulates the quantity of marking particles being transported by said donor member.

3. An apparatus according to claim 2, wherein said charging means includes:

a rotating rod; and means for resiliently urging said rod closely adjacent to said donor roller.

4. An apparatus according to claim 3, further including means for cleaning said rod to remove marking particles therefrom.

5. An apparatus according to claim 4, wherein said cleaning means includes a blade having one end thereof contacting said rod.

6. An apparatus according to claim 1, further including means for discharging additional marking particles into the chamber of said housing.

7. An apparatus according to claim 1, wherein said donor member includes a roller.

8. An apparatus according to claim 7, wherein said moving means includes a rotatably mounted elongated member disposed interiorly of the chamber of said housing in the region of said donor roller.

9. An apparatus according to claim 8, wherein said elongated member includes a hollow rod having a plurality of rows with each row having a plurality of apertures therein.

10. An electrophotographic printing machine of the type in which an electrostatic latent image recorded on a photoconductive member is developed to form a visible image thereof, wherein the improvement includes:

a housing defining a chamber storing a supply of toner particles therein;

means, disposed in the chamber of said housing, for moving the toner particles;

a donor member spaced from the photoconductive member and adapted to transport toner particles to a development zone adjacent the photoconductive member;

means for charging the toner particles being advanced into contact with the latent image by said donor member;

means for electrically biasing said moving means to a voltage having a selected magnitude and polarity; and means for electrically biasing said charging means to a first voltage having the same polarity as the voltage electrically biasing said moving means to attract marking particles to said donor member and to a second voltage opposite in polarity to that of the first voltage to remove toner particles from said donor member.

11. A printing machine according to claim 10, wherein said charging means regulates the quantity of marking particles being transported by said donor member.

12. A printing machine according to claim 11, wherein said charging means includes:

a rotating rod; and means for resiliently urging said rod closely adjacent to said donor roller.

13. A printing machine according to claim 12, further including means for cleaning said rod to remove marking particles therefrom.

14. A printing machine according to claim 13, wherein said cleaning means includes a blade having one end thereof contacting said rod.

15. A printing machine according to claim 10, further including means for discharging additional marking particles into the chamber of said housing.

16. A printing machine according to claim 10, wherein said donor member includes a roller.

17. A printing machine according to claim 16, wherein said moving means includes a rotatably mounted elongated member disposed interiorly of the chamber of said housing in the region of said donor roller.

18. A printing machine according to claim 17, wherein said elongated member includes a hollow rod having a plurality of rows with each row having a plurality of apertures therein.

* * * * *